United States Patent [19]

Hall et al.

[11] Patent Number: 4,966,685

[45] Date of Patent: Oct. 30, 1990

[54] PROCESS FOR EXTRACTING OIL FROM TAR SANDS

[76] Inventors: Jerry B. Hall, 4150 Russell, NW., Cedar Springs, Mich. 49319; Anthony Russo, 6995 Festival Dr., SW., Grand Rapids, Mich. 49508

[21] Appl. No.: 248,996

[22] Filed: Sep. 23, 1988

[51] Int. Cl.[5] ..... C10G 1/04

[52] U.S. Cl. ..... 208/390; 208/391

[58] Field of Search ..... 208/390, 391

[56] References Cited

U.S. PATENT DOCUMENTS

| | | | |
|---|---|---|---|
| 4,270,609 | 6/1981 | Choules | 208/391 |
| 4,402,552 | 9/1983 | Bass et al. | 208/391 |
| 4,443,322 | 4/1984 | Jubenville | 208/391 |
| 4,462,892 | 7/1984 | Schramm et al. | 208/391 |
| 4,514,325 | 4/1985 | Russo et al. | 134/3 |

FOREIGN PATENT DOCUMENTS

| | | | |
|---|---|---|---|
| 891472 | 1/1972 | Canada | 208/391 |
| 1012083 | 6/1977 | Canada | 208/391 |

*Primary Examiner*—Asok Pal

[57] ABSTRACT

A process for the extraction of oil and bitumen fractions from tar sands comprising the steps of heating the tar sands to 70°-150° F., mixing with an aqueous solutions of water soluble separation chemicals, particularly sulfonated fatty acids or salts, holding the tar sand and the separation chemicals for a sufficient period of time to allow the bitumen to float to the top and the sand to sink to the bottom, and separation of the oil or bitumen fractions from water and the separation chemicals.

18 Claims, 2 Drawing Sheets

PROCESS FOR EXTRACTING OIL FROM TAR SANDS

BACKGROUND OF THE INVENTION

This invention relates generally to processes for recovering hydrocarbon product from bitumen or oil laden sands. More specifically, the present invention relates to the process for separating bitumen and related product from tar sands.

Tar sand deposits are known to occur in many of the same areas as petroleum deposits. The largest known reserves of tar sands are found in Canada, in the Northern Alberta deposit called the "Athabasca tar sands". Other large reserves are located in Venezuela, Utah, Oklahoma, Europe and Africa. It has been estimated that approximately sixty-five percent (65%) of all known oil in the world is contained in tar sand deposits, but owing to the difficulties in extracting the oil, little exploitation of the tar sands has taken place notwithstanding a significant world wide demand for crude oil products.

The makeup of the tar sands varies by region, with the Athabasca tar sands being the richest at approximately twelve to thirteen percent (12%–13%) bitumen content by weight. The tar sands in Oklahoma have been reported to contain approximately eleven percent (11%) oil by weight, while the Utah tar sands have been classified at five to thirteen percent (5%–13%) by weight oil content. The richness of the various tar sands can be evidenced by their dark brown to black color. The physically apparent properties of tar sands have caused them to be utilized as paving materials and as "pitch" in earlier times. The present day economics, however, dictate increased importance of the tar sand reserves as a viable alternative to the usual crude oil resources upon which the petroleum related industries rely.

Previous attempts have been made to commercially exploit the tar sands. Those related to the extraction of oils or bitumens have generally failed to prove out economically. As will be seen, these failures are predictable given the chemical circumstances of the prior art where significant energy or chemical inputs are needed to achieve practicable yields of oil or bitumen product.

The bulk of commercial processing of tar sands has resulted from the mining of the Athabasca deposits. The fundamental process utilized for these deposits relies on preconditioning with steam, hot water and alkaline (sodium hydroxide) adjustments to the pH. The vessel is typically rotated or the tar sands agitated in order to reduce the particle sizes. Following this preconditioning, the resulting pulp is transferred and retained in gravity settlers. The initial recovery of bitumen occurs as recovered product floating to the top of the settling vessel. Further processing for secondary recovery of bitumen by means of floatation cells occurs with collection of bitumen in the froth.

The recovered amounts of bitumen in the above described Athabasca process have been reported to equal up to ninety percent (90%) of the available bitumen content. This process also has been reported to have limited commercial viability as it has been unsuccessfully applied to other tar sand deposits.

Other processes known to have been applied to tar sands include the usage of organic solvents for dissolution of bitumen in like chemistries. Variations on the basic use of organic solvents range from the usage of bilayers, a hydrocarbon based solvent layer and a distinct aqueous layer, the use of diluents as preconditioners, and straight forward solvent extractions. In each of the above applications, the solvent is a factor in mobilizing or segregating the bitumen product for the purposes of collection. In some cases additional chemistries come into play such as the use of caustics, wetting agents or surfactants, some of which help to promote more complete mechanical separation of the oils from the sand matrix.

Other methods for extracting oil from tar sands have been demonstrated, however many of these relate to tar sands originating from a particular source, thus possessing characteristics that may allow a chemical advantage in separation. A broad based extraction process for tar sands, utilizing low cost, aqueous formulated chemistries that are functional at moderate to low temperature conditions has not been developed.

The present invention surprisingly achieves the goals of economy and effectiveness with such aqueous based chemistries. The separation chemistry of the present invention employs in part a composition disclosed in U.S. Pat. No. 4,514,325, issued to Russo et al., the subject of that reference being a unique coupling agent generally described as a sulfonated fatty acid alkali metal salt. The compatibility of the present invention with varying conditions and kinds of oils or bitumens allows it to be utilized in related extraction applications, such as the recovery of oils spilled onto the ground. These and other advantages and distinctions of the present invention will become apparent as discussed within.

SUMMARY OF THE INVENTION

A process for extracting oils or bitumen from tar sands comprises admixing the mined tar sands with separation chemicals in an aqueous medium, preferably at elevated temperatures of up to about one hundred and forty degrees Fahrenheit (140° F.). The constituents are maintained at the desired temperature, ideally one hundred and forty degrees Fahrenheit (140° F). The tar sands and separation chemicals are allowed to contact and dwell in a separation vessel under mild agitation. This contact initiates a separation of the oil and bitumen content from the sand.

Settling of the sand occurs during the residence time in the separation vessel. Removal of the sand from the mixture may occur continuously with the operation of the process. After desired residence time has been attained, the mixture is directed to a filtration device where unresolved constituents and bulky impurities are removed from the reaction mixture. The filtrate is then directed to a centrifugal separator where the oil or bitumen is separated from the aqueous separation chemicals.

The recovered separation chemicals is returned to the beginning of the process to be reused. The oil or bitumen recovered is collected and retained for use as petroleum stock. The sand collected from the process may be dried mechanically or it may be spread out to air dry. The extraction of oil or bitumen from the sand is so complete that it may have attributes for use as fill material.

The separation chemicals of the present invention relies primarily on a select class of water soluble coupling agents. The chemicals based on compounds that are selected from the class of sulfonated fatty acids, C12 to C18 carbon chains, with the C-S attachment found in one of the carbon atoms of the residue, and where the SO3 group is associated with an alkali metal, alkaline earth metal or amine. This particular group of coupling agents has been found to be unexpectedly effective in mobilizing and separating the bitumen and oil content in tar sands. Typically, the coupling agents are used in conjunction with water conditioners, surfactants, and lipophilic solvents. The combination causes the mobilization of the organic fractions within the tar sands and floats these with a virtually complete separation from the aqueous vehicle. This result is unique in that the emulsification of any organic fractions is avoided thus allowing the recycling of the separation chemicals.

Additional steps may be taken in order to augment or enhance the process of the present invention. The usage of ultrasonic effect may be employed to increase the speed of separation. The technique is particularly useful where space or process speed are important considerations.

DESCRIPTION OF THE PREFERRED EMBODIMENT

The process of the present invention relies on a unique coupling agent to affect a physical separation of oil or bitumen from tar sands or from other aggregates contaminated or saturated with oil or bitumen. The process produces unexpectedly high yields of oil or bitumen under conditions that are moderate by comparison to the prior art. In addition, economy is achieved in the process of the present invention by recycling the separation chemicals thereby reducing both the costs of chemical consumption and by reducing the amount of energy input necessary to raise the initial thermal content of replenishment chemicals.

Figure 1:
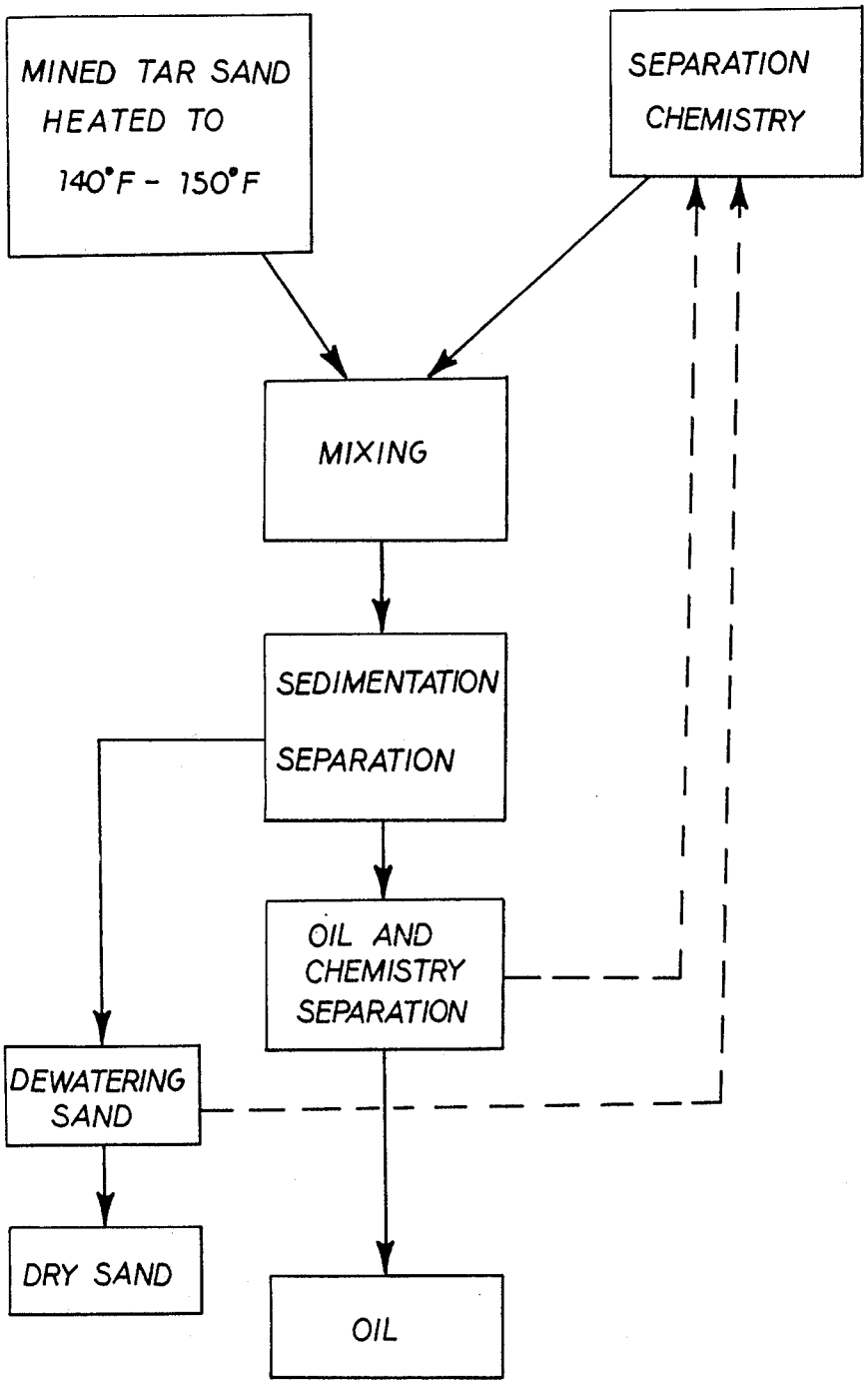
FIG. 1 is a flow chart illustration of the process of the present invention.

Turning now to the drawings, FIG. 1 schematically represents the steps in the process of the present invention. The solid lines indicate the path of product and admixtures through the process while the broken lines indicate the return of separation chemicals. The steps of mixing, sedimentation and separation, and oil and chemicals separation, are diagrammatically represented as individual steps; however, it is feasible for all three to be occurring within the same vessel. Additionally, the dewatering of sand step as displayed in the drawing, may be modified so as to return some of the sand back to the beginning of the process in order to increase yields. This particular option is not shown in FIG. 1 and need only be employed in those situations where the yields are not satisfactory or where the feed stock materials supplied to the system are unusually resistent to extraction.

Testing of the process of the present invention has indicated an unusually quick separation of oil and bitumen to occur. Samples of Oklahoma Ridge tar sands have gone to substantially complete separation within five minutes after admixing with the separation chemicals. It is predicted that not all tar sands will exhibit this degree of efficiency and process times will have to be adjusted accordingly.

Figure 2:
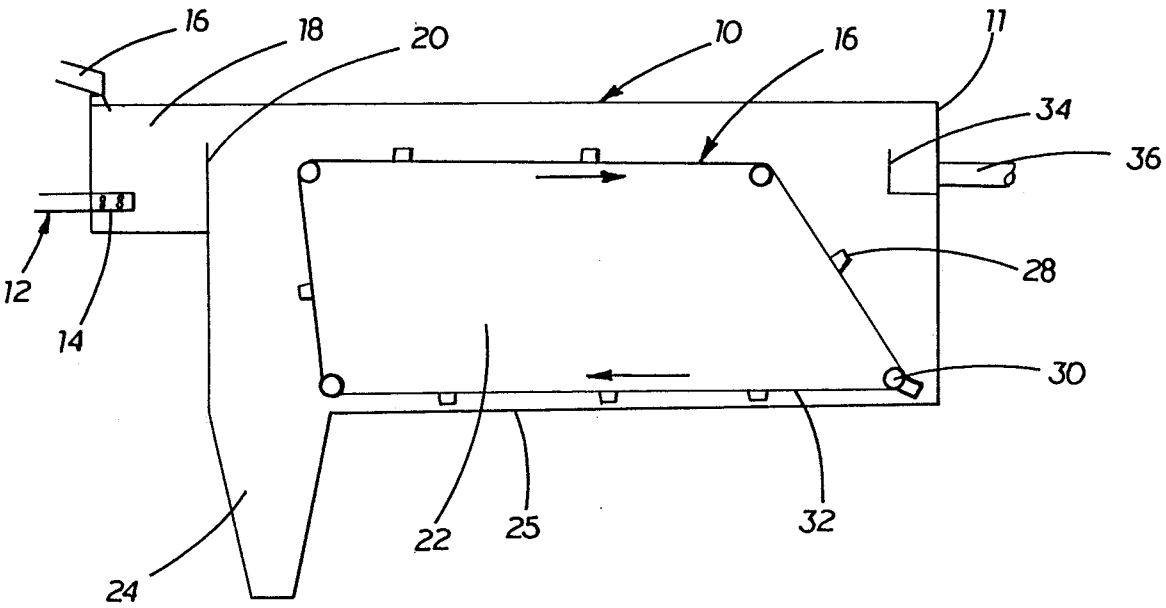
FIG. 2 is a cross-sectional side elevation of a separation vessel used in the process of the present invention.

Turning now to FIG. 2, a separation vessel of the kind suited for use in the present invention is shown. The separation vessel 10 is shown in a side elevational cross section, and is in a substantially rectangular shape. The vessel is defined by walls 11 which may be constructed from steel panels or from concrete or any other material that is suitable for the conditions of hydrostatic loading, chemical resistance, and temperature involved. Processing through the separation vessel commences with the separation chemical inlet 12 and the tar sand inlet 16. The separation chemical inlet is represented as a pipe fitted into a cantilevered portion of the separation vessel and terminating therein with distribution ports 14. The tar sand inlet is typically a chute that is angled to promote the even flow of tar sand into the separation vessel. Tar sands may be delivered to the chute by means of a conveyor, or in the alternative, the tar sand inlet 16 may actually be the terminus point of a conveyor.

The cantilevered portion extending from the separation vessel is termed the flash mix zone 18. It typically runs the width of the separation vessel and communicates with the separation vessel by means of the inlet overflow 20. The flash mix zone is water tight and the incoming feed stock and separation chemical stream flood the flash mix zone filling it to at least the level of the inlet overflow causing the contents of the flash mix zone to thereafter spill over into the balance of the separation vessel.

The separation vessel itself is predominantly occupied by the settling zone 22. A sump 24 is disposed near the head or inlet end of the separation vessel with accommodations for receiving sediment and sand. Devices used for removal of sump collected materials are typically installed adjacent to or within the sump itself; however, for simplicity of illustration in this case, these devices are not represented in the drawing.

Continuing, the separation vessel is also comprised of floor 25 which is shown in the drawing as slightly inclined downwardly towards the outlet end of the separation vessel (on the right in FIG. 2). The floor is in contact with the flight mechanism 26 which includes sprocket 30 which engages a chain 32 containing paddles or flight 28. The direction of drive in this case is indicated by the arrows in FIG. 2. The drive means for the flight mechanism is typically an electrically geared motor connected by a chain to an individual sprocket. The drive means, again for simplicity of illustration, is not represented in the drawing.

The outlet end of the separation vessel includes the overflow weir 34 and the outlet 36. The overflow weir 34 being the determinant of the water level within the separation vessel and by necessity therefore, at an elevation somewhat below that of the inlet overflow 20.

The introduction of mined tar sands and separation chemicals through their relative inlets at the head of the separation vessel is vigorous enough within the confines of the flash mixing zone so as to agitate and mix the two thoroughly. This action may be augmented by other mixing devices if necessary. Once the flow has filled the flash mix zone and breaches the inlet overflow, the quiescent conditions in the settling zone promote further separation. Initially a fall out of heavy sediments and particles is collected in the sump. Continuous modest agitation is provided by the action of the flights which not only sweep collected sediments and sand from the floor of the separation vessel to the sump, but also provide a gentle mixing action near the water line of the separation vessel where the process of separating the oil from the water based chemicals predominantly occurs.

The flights travel in an endless loop around the sprockets. As indicated above, one of the sprockets may be selected as the driving sprocket for energizing the mechanism. Typically this is through means of an electric motor with gear reduction so as to provide a slow measured action. The flights operate best at speeds less than fifty (50) feet per minute, although speeds greater then this, short of causing frothing, will work. The preferred technique is to adjust the speed in conjunction with the accumulation of sediments and sand so as to prevent large buildups on the floor of the vessel. Sweeping the floor too fast, i.e., at speeds greater than fifty (50) feet per minute, could cause damage to the flights.

As the mixture of chemical and tar sand components proceeds through the separation vessel, the sand continues to sediment or fall out to the bottom of the separation vessel and then is urged towards the sump where it is collected and transported for further processing. The separation of the oil and bitumen from the aqueous chemicals continues as the flow proceeds towards the outlet of the separation vessel. The upper portion of the flight mechanism preferentially terminates at a position distant from the overflow weir. In this way, agitation is completely eliminated in the area just before the overflow weir as a means to improve the overall separation of the components. The placement of the overflow weir dictates the water line within the separation vessel. The overflow weir acts as a dam which preferentially takes the upper layer off from the flow going through the separation vessel. The overflow weir is connected to the outlet 36 which may then be directed to the next step in the process, i.e., the further separation of oil or bitumen from the water based chemicals.

In the preferred embodiment of the present invention, a separation vessel of three hundred thousand (300,000) gallons would be employed to process a combined feedstock and separation chemicals flow of one hundred and fifty thousand (150,000) gallons per hour. This would establish the residence time in the separation vessel at two (2) hours which has been more than ample time to affect yields of ninety-three percent (93%) to ninety-seven percent (97%).

The feedstock tar sands are admixed with the separation chemicals in a ratio of 1:9, respectively, volume to volume. Thus the preferred embodiment is scaled to output approximately fifteen hundred (1,500) gallons per hour of oil or bitumen product. The actual quantity produced is dependent on the quality of feedstock, the actual yield realized, and the types of separation devices utilized.

As will be discussed further, ultrasonic transducers may be placed throughout the separation vessel for the purposes of enhancing the separation process. The ultrasonic means does not interfere with or preclude any of the previously described steps of the process of the present invention and may in some circumstances allow the reduction in the sizing of the separation vessel and related components.

The steps of the process will be discussed individually as will the chemical parameters utilized in the separation chemicals.

Feedstock Input

Raw tar sands (although feedstocks may impliedly include contaminated or saturated aggregates of other types) are mined and supplied to the process. Usually no chemical preconditioning of the tar sands is necessary as is the case in some other processes. In addition, no sizing requirements are set since the typical tar sands are not agglomerated, but exist in a fluid, if very viscous, state. Exceptions to this would include situations where the tar sand matrix contained other insoluble or bulky solids. In that event, it is believed that the usual pretreatment for products such as coal or other mined resources would be employed to reduce particle size to a manageable level.

Some tar sand samples utilized in tests of the present invention were obtained from the Oklahoma Ridge deposits. These samples were run under the process conditions of the preferred embodiment without pretreatment or conditioning and proved out the efficiencies and tolerance of the process. In addition, so-called synthetic tar sands were created in the laboratory in order to simulate oil or hydrocarbon separations in an aggregate matrix other than tar sands. These tests similarly proved out the process without the necessity of a pretreatment or conditioning step.

Mechanically feeding the mined tar sands to the process requires a continuously acting device. Typically these may be auger or screw feeds, gravity hoppers, or conveyorized transport. The actual means selected is dependent to some extent on the equipment available nearest the tar sand site since it is contemplated that most applications of the present invention will be situated near the feedstock resource. The choice in any event is not critical to the process.

Heating of Feedstock

The tar sands are delivered to a storage hopper or other containment device and are preferrably heated for a residence time sufficient to raise the feedstock temperature to approximately one hundred forty degrees Fahrenheit (140° F.). The selection of the temperature in this case is a balance between economics and effect. Tests on the tar sands have shown that the temperature range of one hundred forty degrees Fahrenheit (140° F.) to one hundred fifty degrees Fahrenheit (150° F.) is very efficient in promoting separation. Lower temperatures, ambiant and below, will work but at such reduced speed as to greatly increase the requirements for residence times. Temperatures greater than one hundred fifty degrees Fahrenheit (150° F.) virtually to the point of boiling will also work. A working range of the present invention has been established as seventy degrees Fahrenheit (70° F.) to approximately one hundred fifty five degrees Fahrenheit (155° F.). Given the lack of precise control over temperature in a process where large volumes of material are handled, a wide working range is necessary to prevent upsets and inefficiencies.

The apparent viscosity of the feedstock tar sands is reduced when the temperature is elevated, thus making the product more manageable and better suited for mixing and blending during the other steps in the process. Economy is achieved by keeping the temperature at approximately the one hundred forty degree Fahrenheit (140° F.) temperature because heat loss due to radiation and convection increases greatly at temperatures above this.

For the purposes of the preferred embodiment, the selection of one hundred forty degrees Fahrenheit (140° F.) represents the optimum temperature.

The feedstock tar sands may be heated by electrical resistance methods or through the use of steam coils. The selection is merely an engineering choice, and probably site dependent. If the facility does preliminary cracking of the output crude produced by the present invention, then it is possible that a boiler may be fueled by a portion of the tar sand extraction process itself.

Separation Chemicals Additions

The heated tar sand feedstock is conveyed or transported to the head of a separation tank. The vessel for this purpose may be rectangular or circular, but it must be of sufficient capacity to provide enough dwell time for the separation to go to completion. An agitation means may be provided at the inlet position of the separation tank in order to thoroughly mix the incoming feedstock and separation chemicals.

The separation chemicals are water based and are pumpable. They are delivered to the inlet position of the separation tank where they are combined with the tar sand feedstock. The agitation provided should be great enough to provide contact of the tar sand with the aqueous materials, dispersing the tar sands and creating a suspension-like fluid. In the preferred embodiment, the agitation is best provided by a series of flights on a submerged endless conveyor. These flights are of a type manufactured by Link-Belt Company and are typically supplied as redwood paddles connected at the ends to chain drives. The speed at which these paddles operate may be adjusted specifically to fit the particular feedstock, process temperature and tank configuration.

The mild agitation of the separation chemicals and the tar sands is sufficient to promote the mobilization of the oil or bitumen. As will be explained further in this specification, the particular chemicals advantageously causes a clean bilayer to develop whereby the oil and/or bitumen fraction is floated and the separation chemicals remain intact with the aqueous portion The creation of this bilayer is exploited in subsequent steps of the process.

Other agitation methods are known that would predictably work in the present invention. These would include low speed turbine mixers, screw type "prop" mixers, in line mixing, air agitation, and others well known in the field of chemical engineering. The selection of a flight system is desirable because it has secondary advantages, as described below.

Sand Separation

The separation chemicals combined with the agitation works to promote the sedimentation of the sand particles in the feedstock. Typically flow rates of one foot per second or less are necessary to cause such sedimentations and conditions within the separation tank are usually much less than this. The usage of the specific separation chemicals results in a sand that is surprisingly clean especially when compared to the sand recovered other known processes.

The collection of the sand is aided by the flights. In the preferred embodiment of the present invention, the flights are used to simultaneously urge the sand being deposited on the bottom of the vessel towards a collection point, while the same action of the flights on the upper part of the tank is promoting mixing and separation of the feedstock and separation chemicals. Dual utilization of the flights occurs avoiding some redundancy in the equipment used in the process.

Sand that is collected by flight action is preferably urged into a sump built into the separation tank. The sump may be pumped or augured for sand removal or the tank may be emptied periodically in order to remove accumulations of sand. In either event, the removal of sand from the tank is a consequence of the process of the present invention. The sand may be further handled by spin drying in order to reduce gross moisture content. Tests have indicated that the sand recovered by the process of the present invention may be suited for use as a fill material and would in that event have a ready outlet for disposal. A concern with some of the extraction processes that are known is the problem of dealing with processed sands that still retain as much as ten percent (10%) bitumen content, or worse, some that contain environmentally significant amounts of halogenated hydrocarbon solvents as a direct result of an extraction process. The chemicals and method of the present process avoids both such problems.

In those situations where the oil/bitumen content of the recovered sand is considered too high either for use as fill or because of economics, then provisions can be made to route the sand back through the separation vessel again, reagitating the once worked sand and recontacting it with separation chemicals. Tests have indicated that yields of oil/bitumen product are increased in this way and the desirability of the recovery enhanced.

Oil/Bitumen Separation

The mixture of oil or bitumen content with the separation chemicals is taken from the outlet of the separation tank and passed through a polishing filter. The choice of a particular filter is not a critical selection within the process and is dependent in part on the particular feedstock being supplied. The existence of solids, inerts or other impurities in the effluent from the separation tank will dictate the filtration requirements. In general though, the function of the filter is to remove all extraneous debris from the process, such as cigarettes, rocks, sticks, etc.

The polished effluent is continuously transported, via pump or gravity, to a centrifuge. The actual physical separation of the oil or bitumen from the water based separation chemicals is exaggerated or augmented by the centrifugal action. The result is recovery of a crude oil type product equal to approximately ninety-three percent (93%) to about ninety-seven percent (97%) of the total available hydrocarbon content in the tar sand feedstock tested to date.

The oil/bitumen yield is retained as the product of the process and the aqueous separation chemicals are returned to the inlet of the separation tank. Some loss of the separation chemicals occurs, although through the usage of the particular chemicals of the present invention, the ability to recover approximately ninety percent (90%) of the separation chemicals represents a significant advantage and improvement in the usage of water based extraction processes for tar sands.

Recycled separation chemicals have been examined for efficacy in benchtop testing. Performance factors have remained the same in these tests, although it may be predicted that in particular feedstocks, especially those that may contain concentrations of salt or divalent metals, the necessity for periodic or continuous purging of recycled chemicals could arise. This requirement would allow the introduction of replenishment chemicals in order to overcome the potential interferences.

In an alternate route, a second pass of the separation chemicals recovered from the centrifuge may be made in order to increase the yield of oil/bitumen. Preferably in a continuous process this would entail a second centrifuge whereby select conditions for maximizing oil/- bitumen recovery in the second separation could be established.

Other physical separation methods are known and could be employed in the process of the present invention. These include the use of reverse osmosis membranes, high density filters, and other techniques known to those working in the field of oil and water separation.

Separation Chemicals

The usage of coupling agents selected from sulfonated fatty acid compounds is a unique application of this class of chemicals. An unexpectedly efficient reaction is obtained in applying certain chemicals of this class to mined tar sands.

The preferred sulfonated fatty acid of the present invention is the sodium salt of oleic acid. While other fatty acids in the parent class will work to varying degrees, the selection of oleic acid comes about as the result of much experimentation of various vehicles, additives and specific fatty acids.

The major chemical advantage observed in using the sulfonated fatty acids is the avoidance of emulsions which complicate the recovery of oil and bitumen in the extraction. The efficiency of these compounds in working in the aqueous environment is also a significant factor in mobilizing the oil and bitumen and promoting the separation of a clean sand. The sands recovered by the present invention have significantly less hydrocarbon content than is known in other processes.

The preferred class of sulfonated fatty acids are selected from the class of compounds where the fatty acid residue contains a C12 to C18 unsaturated chain, with a C-S attachment in one of the carbon atoms of the residue. In addition, the sulfonated moiety included an alkaline metal, alkaline earth metal or amine.

While they may be effective in inducing separation, coupling agent formulations including halogenated organic solvents are not employed in the present invention because of the environmental sensitivity of using such compounds. The bulk of the mined tar sands exit the process of the present invention as a cleaned sand product. The indications are that this product may be usable as a fill material in many jurisdictions although this usage would be curtailed if a halogenated solvent was utilized.

As shown in Example 1, the preferred formulation for the separation chemicals of the present invention relies on the sodium salt of sulfonated oleic acid. Other compounds such as sodium silicate, liquid potassium phosphate and the anionic and nonionic surfactants are preferably added for water conditioning. Liquid caustic soda, tetra hydrofurfuryl alcohol, ethylene glycol monophenyl ether are added to promote separation of the bitumen/oil content in the tar sand.

EXAMPLE 1

EXAMPLE 1

| FORMULA | % BY WEIGHT | ORDER OF FORMULATION |
|---|---|---|
| SODIUM SILICATE* | 7.0% | 2 |
| LIQUID CAUSTIC SODA (50%) | 8.0% | 3 |
| SULFONATED OLEIC ACID, Na SALT | 6.0% | 10 |
| NONIONIC SURFACTANT | 5.0% | 7 |
| ANIONIC SURFACTANT | 5.0% | 8 |
| LIQUID POTASSIUM PHOSPHATE | 10.0% | 4 |
| TETRA HYDROFURFURYL ALCOHOL | 11.0% | 5 |
| ETHYLENE GLYCOL MONOPHENYL ETHER | 5.0% | 6 |
| DEFOAMER | 0.1% | 9 |
| WATER, DEIONIZED | BALANCE TO 100% | 1,11 |

*May be substituted with alkali silicates, subsilicates, alkali metal hydroxides, and alkali metal phosphates.

It can be seen from the foregoing that modifications in the above formula can be made, such as substituting some of the water conditioning or lipophilic chemicals with wellknown analogues. Such changes do not detract from the process of the present invention so long as the changes still promote the clean separation of oil and bitumen from the aqueous matrix. Less efficient combinations may increase the potential for emulsion layers to develop which would thereby reduce the efficiency of the recovery. The usage of the sulfonated fatty acid coupling agent, however, allows more latitude in such formulations for avoiding the emulsion problem.

The usage of a defoaming agent, such as a silicone oil, avoids the consequences of frothing which in this process is an unnecessary and undesirable event. The selection of the particular defoamer is not critical to the formulation, and the actual amount applied may vary depending on the source and quality of the feed stock materials being supplied to the process.

The usage of deionized water in the formulation is a matter of preference in that it results in a matrix that is relatively chemically pure. In actual practice, however, the matrix soon becomes polluted with water soluble impurities found in both the chemicals of the formulation and impurities within the feed stock itself. Although tests have indicated that these impurities do not pose any obstacles to the recycling of the separation chemicals as a whole, it is foreseeable that feed stocks with significant amounts of water soluble impurities may reduce the efficiency of the separation chemicals, thereby requiring the necessity of a purge from time to time. Such a procedure only moderately detracts from the economics of utilizing the process of the present invention.

The process of the present invention may be augmented in other ways than the described steps above. Methods used to promote separation of oils from sand may be used in addition to the present process to increase the speed and/or the efficiency of the process. Specifically, the use of ultrasonic sound waves in the separation tank has been shown to substantially improve the speed of the present process. Transducers are located at staged positions within the separation tank so as to broadcast ultransonic waves through the flow of the separation mixture. The sound waves have a mechanical effect upon the organic material attached to the sand particles and promote the separation of the two. When utilized in conjunction with the process of the present invention, the result is an oil separation that proceeds much more quickly with much more efficiency than would otherwise be expected through the use of either chemistry or ultrasound techniques alone.

It is possible to practice the process of the present invention in other ways that would be obvious to one skilled in the art of separation processes generally. Such modifications do not deter or detract from the concepts embodied in this disclosure, such embodiments serving to illustrate and explain the practice of the present invention and do not in any way represent a limitation in the scope of applications of same.

The embodiments of the invention in which an exclusive property or privilege is claimed are defined as the following:

1. A process for the extraction of oil and bitumen fractions from tar sands comprising the steps of:

heating the tar sands within the range of about seventy degrees Fahrenheit (70° F.) to about one hundred fifty five degrees Fahrenheit (155° F.);

mixing the mined tar sands with an aqueous solution of water soluable separation chemicals that induce separation of the oil and bitumen from the sand under such temperature conditions, the chemicals being such that they also induce separation of the oil and bitumen from the water and separation chemicals, the separation chemicals comprising an aqueous solution of an effective amount of water conditioner, wetting agents and a coupling agent selected from the group consisting of sulfonated fatty acid salts;

holding the mined tar sands and the separation chemicals for a sufficient period of time under sufficient quiescent conditions that the oil and bitumen become substantially separated from the sands, the separated oil and bitumen floating on the water and the sand sinking in the water;

segregation of the oil or bitumen fractions from the water and separation chemicals and retention of the fractions for use as a chemical resource.

2. A process as in claim 1 where the mined tar sands are heated to no more than about 140° F.

3. A process as in claim 1 including the step of filtering the oil and bitumen fraction and separation chemicals after they have been separated from the sunken sand, so as to further remove solid materials remaining in the liquids.

4. A process as in claim 1 where the segregation of the oil and bitumen fractions from the separation chemicals comprises treatment by centrifugal means.

5. A process as in claim 1 wherein the coupling agent comprises one or more of the members of the group consisting of sulfonated fatty acid residue of C12 to C18 carbon chain length where the C-S attachment is to one of the carbon atoms of the residue, and where the $SO_3$ moiety is associated with an alkali metal, alkaline metal earth, or an amine.

6. A process as in claim 1 wherein the wetting agent comprises an anionic or a nonionic surfactant or a combination thereof.

7. A process as in claim 1 and further comprising segregation of the sand from the liquids in the mixture and returning the separation chemicals to the process for reuse.

8. A process as in claim 1 wherein the mixture of the sands and aqueous separation chemicals is held under conditions of mild agitation that enhance separation yet do not induce substantial frothing of liquids.

9. A process as in claim 8 wherein the mixture is held in a separation tank where separation occurs, the oil and bitumen floating to the top of the liquid in the tank and being removed therefrom, the sand sinking to the bottom of the tank.

10. A process as in claim 9 wherein the liquid removed from the tank containing the oil and bitumen is further subjected to centrifugal separation to more completely separate the oil and bitumen from the aqueous solution.

11. A process as in claim 1 wherein the mixture of tar sands and the aqueous separation chemicals is continuously added to a separation tank and retained in the tank under sufficiently quiescent conditions until the oil and bitumen substantially separate from the sand, water, and separation chemicals and float on the water, with the sand sinking to the bottom of the tank, sand being removed from the bottom of the tank at a rate sufficient to prevent an undesirable extent of sand build up in the tank, the liquids being continuously segregated from the sand by removal of the liquids from the tank at a level above the sunken sand.

12. A process as in claim 11 wherein the liquid removed from the separation tank is subjected to further separation based on the specific gravity of the liquids to further separate the oil and bitumen from the water and separation chemicals.

13. A process as in claim 12 wherein the further separation comprises centrifugal separation.

14. A process as in claim 13 wherein the aqueous separation chemicals are recycled for reuse in the process.

15. A process as in claim 11 wherein the sand is recycled through the process to the extent necessary to remove enough oil and bitumen to render the sand satisfactory for use as fill material.

16. A process as in claim 11 wherein the mixture is agitated in the separation tank by a flight system wherein a plurality of spaced flights mounted on a chain conveyor rotate through an upper portion of the separation tank and then pass adjacent the bottom of the tank where they convey sand to a location wherein removal means discharges the sand from the tank.

17. A process for extraction of oil and bitumen fractions from tar sands comprising the steps of:

heating the tar sands;

mixing the tar sands with separation chemicals comprising an aqueous matrix of water conditioners, wetting agents and a coupling agent selected from the group consisting of sulfonated fatty acid salts;

retaining the tar sands and the separation chemicals in a condition such that the oil and bitumen separate from the sand and from the separation chemicals;

separating the oil and bitumen fraction from the separation chemicals and sand and retaining the oil and bitumen fraction for use as a chemical resource;

returning the separation chemicals to the process.

18. A process as in claim 1 or 17 where the separation of the sand from the oil or bitumen fraction is augmented by an ultrasonic means.

* * * * *